US005927489A

United States Patent [19]

Carswell

[11] Patent Number: 5,927,489

[45] Date of Patent: Jul. 27, 1999

[54] TOWEL WITH PROTECTIVE COVER ASSEMBLY

[76] Inventor: Neil Carswell, P.O. Box 1420, Narre Warren, Victoria, Australia, 3805

[21] Appl. No.: 08/960,978

[22] Filed: Oct. 30, 1997

[51] Int. Cl.[6] ..... B65D 85/20

[52] U.S. Cl. ..... 206/315.1; 206/38; 383/33; 383/67

[58] Field of Search ..... 206/315.1, 315.2, 206/315.3, 315.5, 315.8, 38; 383/33, 67; 150/154

[56] References Cited

U.S. PATENT DOCUMENTS

| | | | |
|---|---|---|---|
| 2,654,892 | 10/1953 | Szabo | 383/33 |
| 4,765,381 | 8/1988 | Castle | 383/33 |
| 4,787,753 | 11/1988 | Barnhart | 383/33 |
| 5,011,103 | 4/1991 | Hayes et al. | 248/99 |
| 5,161,683 | 11/1992 | Smith | 206/315.1 |
| 5,183,339 | 2/1993 | Williams | 383/33 |
| 5,341,933 | 8/1994 | Willows | 206/554 |
| 5,372,414 | 12/1994 | Lamonakis et al. | 312/3 |
| 5,450,954 | 9/1995 | Dunn | 206/315.5 |
| 5,590,773 | 1/1997 | Robinett | 206/315.1 |

*Primary Examiner*—Paul T. Sewell
*Assistant Examiner*—Nhan T. Lam

[57] ABSTRACT

A new towel with protective cover assembly for keeping a towel dry and protected from the weather. The inventive device includes a protective sheath member having an inner surface defining a hollow interior with an opening into the hollow interior at its open end. A towel is disposed within the hollow interior. An attachment member is coupled to the towel and the closed end of the protective sheath member and is designed for attachment to an object such as a golf bag or a piece of luggage. A stiffening member having a central opening is disposed within an annular pocket formed at the open end of the protective sheath member for helping slide the open end over the towel to either cover it or expose it.

1 Claim, 2 Drawing Sheets

TOWEL WITH PROTECTIVE COVER ASSEMBLY

BACKGROUND OF THE INVENTION

1. Field of the Invention

The present invention relates to protected towel assemblies and more particularly pertains to a new towel with protective cover assembly for keeping a towel dry and protected from the weather.

2. Description of the Prior Art

The use of protected towel assemblies is known in the prior art. More specifically, protected towel assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art protected towel assemblies include U.S. Pat. No. 4,953,603; U.S. Pat. No. 5,450,954; U.S. Pat. No. 5,419,477; U.S. Pat. No. 5,161,683; U.S. Pat. No. 5,009,327; and U.S. Pat. No. Des. 329,564.

While these devices fulfill their respective, particular objectives and requirements, the aforementioned patents do not disclose a new towel with protective cover assembly. The inventive device includes a protective sheath member having an inner surface defining a hollow interior with an opening into the hollow interior at its open end. A towel is disposed within the hollow interior. An attachment member is coupled to the towel and the closed end of the protective sheath member and is designed for attachment to an object such as a golf bag or a piece of luggage. A stiffening member having a central opening is disposed within an annular pocket formed at the open end of the protective sheath member for helping slide the open end over the towel to either cover it or expose it.

In these respects, the towel with protective cover assembly according to the present invention substantially departs from the conventional concepts and designs of the prior art, and in so doing provides an apparatus primarily developed for the purpose of keeping a towel dry and protected from the weather.

SUMMARY OF THE INVENTION

In view of the foregoing disadvantages inherent in the known types of protected towel assemblies now present in the prior art, the present invention provides a new towel with protective cover assembly construction wherein the same can be utilized for keeping a towel dry and protected from the weather.

The general purpose of the present invention, which will be described subsequently in greater detail, is to provide a new towel with protective cover assembly apparatus and method which has many of the advantages of the protected towel assemblies mentioned heretofore and many novel features that result in a new towel with protective cover assembly which is not anticipated, rendered obvious, suggested, or even implied by any of the prior art protected towel assemblies, either alone or in any combination thereof.

To attain this, the present invention generally comprises a protective sheath member having an inner surface defining a hollow interior with an opening into the hollow interior at its open end. A towel is disposed within the hollow interior. An attachment member is coupled to the towel and the closed end of the protective sheath member and is designed for attachment to an object such as a golf bag or a piece of luggage. A stiffening member having a central opening is disposed within an annular pocket formed at the open end of the protective sheath member for helping slide the open end over the towel to either cover it or expose it.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein arc for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new towel with protective cover assembly apparatus and method which has many of the advantages of the protected towel assemblies mentioned heretofore and many novel features that result in a new towel with protective cover assembly which is not anticipated, rendered obvious, suggested, or even implied by any of the prior art protected towel assemblies, either alone or in any combination thereof.

It is another object of the present invention to provide a new towel with protective cover assembly which may be easily and efficiently manufactured and marketed.

It is a further object of the present invention to provide a new towel with protective cover assembly which is of a durable and reliable construction.

An even further object of the present invention is to provide a new towel with protective cover assembly which is susceptible of a low cost of manufacture with regard to both materials and labor, and which accordingly is then susceptible of low prices of sale to the consuming public, thereby making such towel with protective cover assembly economically available to the buying public.

Still yet another object of the present invention is to provide a new towel with protective cover assembly which provides in the apparatuses and methods of the prior art some of the advantages thereof, while simultaneously overcoming some of the disadvantages normally associated therewith.

Still another object of the present invention is to provide a new towel with protective cover assembly for keeping a towel dry and protected from the weather.

Yet another object of the present invention is to provide a new towel with protective cover assembly which includes In a particularly preferred form of the invention, a generally tubular protective sheath member is formed from a fabric material which is water repellant on both sides, the protective sheath member being flattened at its closed end with a hole extending through each of the two layers of fabric at the flattened, closed end. The hole in each layer of fabric is preferably surrounded by a reinforcement ring. With such an arrangement, the water repellant protective sheath member is reversible, and a towel can be readily attached to a hook, clip or other attachment member extending through the holes and then the protective sheath member can be pulled over the towel to enclose the towel within the protective sheath member. A reversible protective sheath member made from water repellant fabric on both sides also facilitates cleaning and drying of the towel cover.

It is known for golfers to carry hand towels or rags for cleaning their golf balls and club heads and for drying their hands when they become sweaty or wet during inclement weather conditions. Such hand towels normally have a hole surrounded by a reinforcement ring provided in one corner of the towel to enable the towel to be suspended by a hook or other attachment member from a golf bag or golf trolley. However, when a golf towel is freely suspended from a golf bag or trolley during a round of gold in rainy weather, the towel can quickly become saturated and then the golfer is unable to dry his or her hands.

It is therefore desirable to provide a cover for a towel or the like which is adapted to keep the towel dry in rainy weather.

It is also desirable to provide a water repellant towel cover that is relatively inexpensive to manufacture.

It is further desirable to provide a water repellant towel cover, which allows easy access to the towel, so that a user, such a golfer, can conveniently dry his hands or equipment.

According to one aspect of the invention, the protective sheath member 20 is made from a water repellant material and adapted to contain a towel 12 or other article, and attachment member for attaching the protective sheath member to an object, wherein the protective sheath member is provided with an opening which allows access to a towel or other article contained within the protective sheath member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
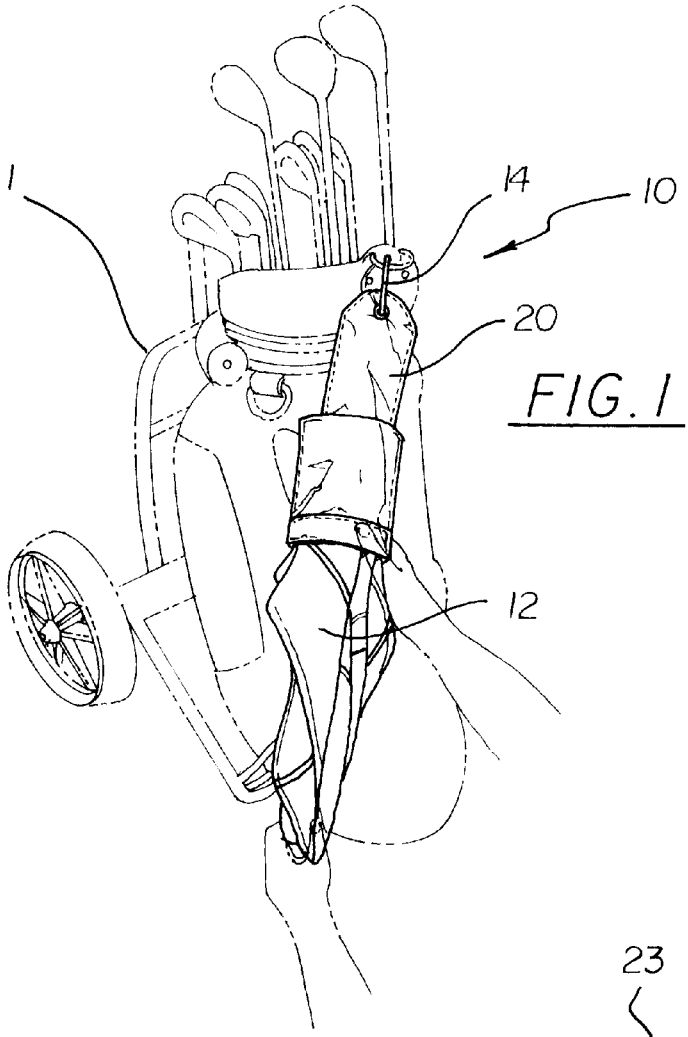
FIG. 1 is a schematic perspective view of a new towel with protective cover assembly in use with the towel exposed from the protective sheath member according to the present invention.
Figure 2:
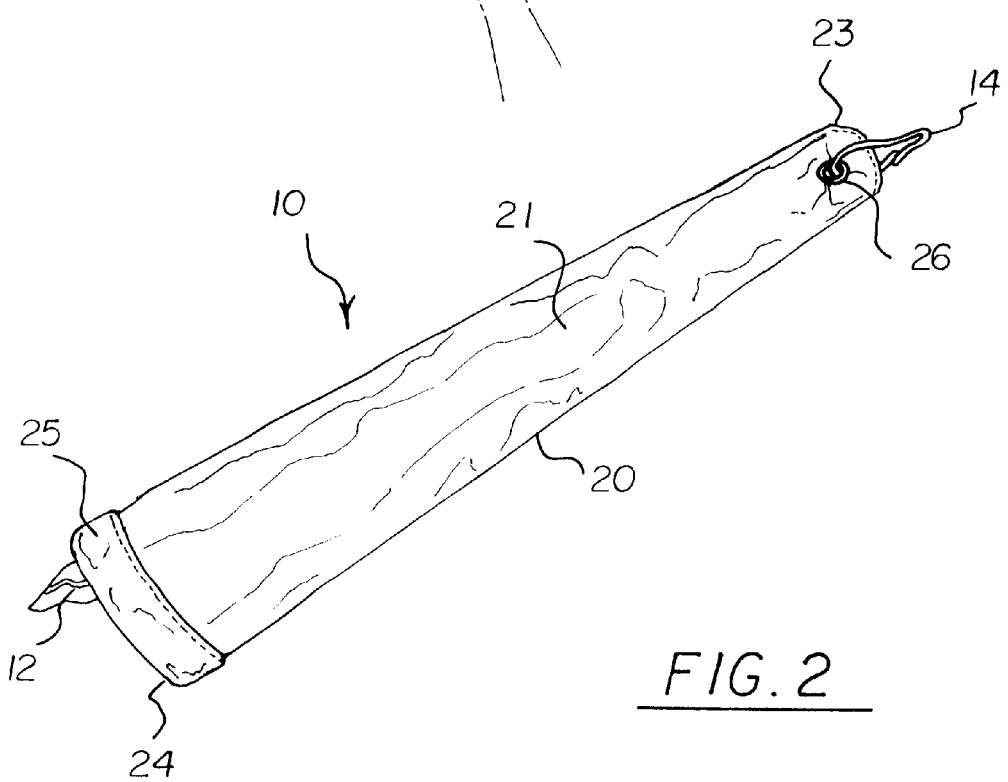
FIG. 2 is a schematic side view of the present invention with the towel covered by the protective sheath member.
Figure 3:
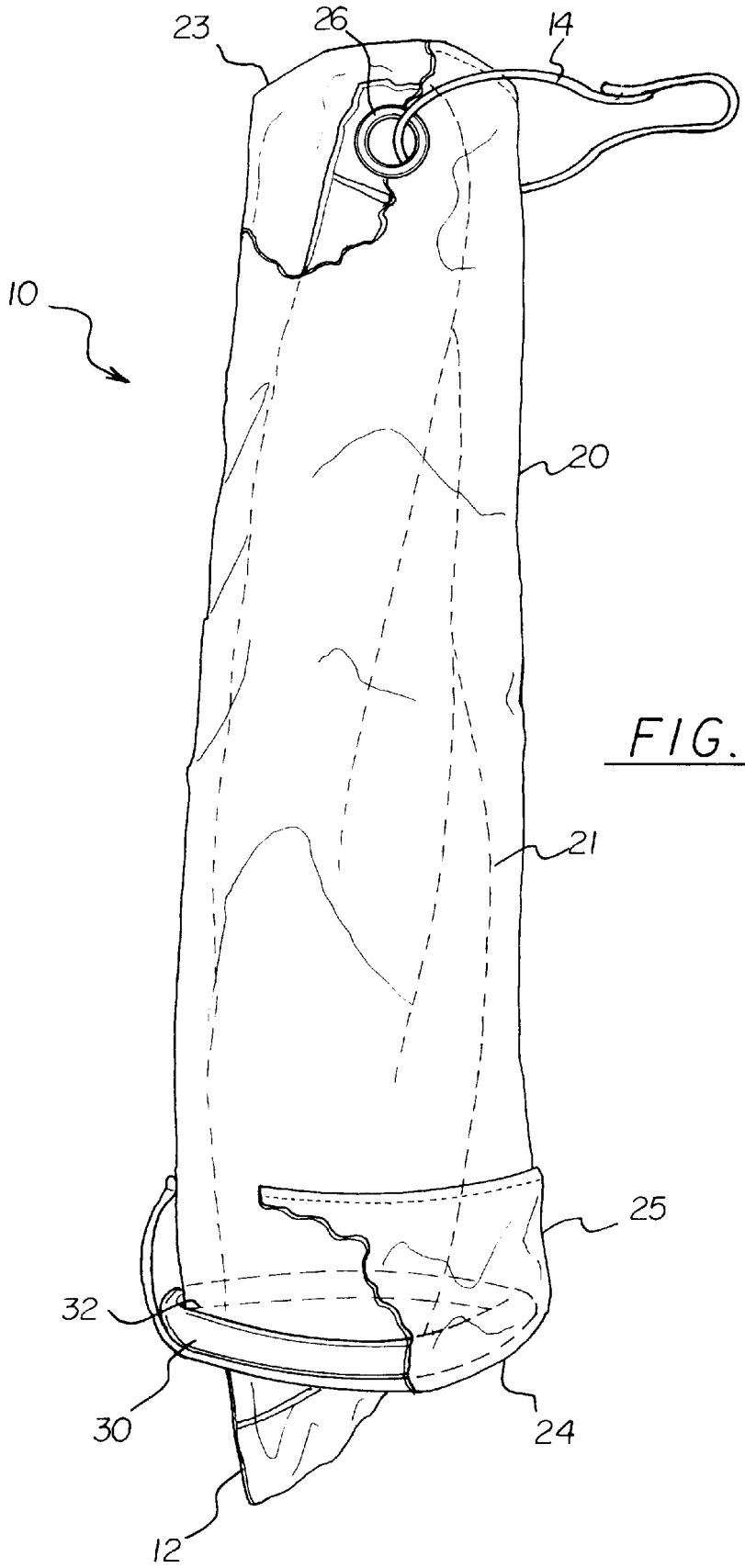
FIG. 3 is a schematic partial break-away side view of the present invention.

With reference now to the drawings, and in particular to FIGS. 1 through 3 thereof, a new towel with protective cover assembly embodying the principles and concepts of the present invention and generally designated by the reference numeral 10 will be described.

As best illustrated in FIGS. 1 through 3, the towel with protective cover assembly 10 generally comprises a protective sheath member 20 having an inner surface defining a hollow interior (not shown) with an opening into the hollow interior at its open end 24. A towel 12 is disposed within the hollow interior. An attachment member 14 is coupled to the towel 12 and the closed end 23 of the protective sheath member 20 and is designed for attachment to an object 1 such as a golf bag or a piece of luggage. A stiffening member 30 having a central opening 32 is disposed within an annular pocket 25 formed at the open end 24 of the protective sheath member 20 for helping slide the open end 24 over the towel 12 to either cover it or expose it.

The protective sheath member 20 may be made from any convenient water repellant material. Preferably, the protective sheath member 20 is made of a water repellant fabric material, such as nylon.

The protective sheath member 20 may take any desired shape, but preferably the protective sheath member 20 is in the form of an elongate tube.

Preferably, as shown in FIG. 3, the open end opening 24 in the protective sheath member may be permanently open. Ideally, the opening is conveniently located at a side or end of the protective sheath member 20 remote from an opposite side or end at which the attachment member 14 is provided so that, when the towel cover 10 is suspended by the attachment member from an object such as a golf bag, trolley or the like, the open end opening 24 is disposed below the closed end 23 of the protective sheath member. Thus, in the use, rain striking the towel cover 10 will run down the outside of the protective sheath member 10 and not wet the towel 12 within.

Optionally, the open end opening 24 into the hollow interior of the protective sheath member may be closeable by a fastening means, such as by strips of hook and loop fastening material sold commercially under trademark "VELCRO" provided on opposite sides of the opening or by a zip fastener or other fastening means.

In a particularly preferred embodiment of the invention, the protective sheath member 30 comprises an elongate, generally tubular protective sheath member having a closed end 23 at which the attachment member 14 is provided, and with the stiffening member 30 provided extending at least partly around the opening at the open end 24 of the protective sheath member 30. The stiffening member 30 may comprise an open or closed ring or loop which partially or wholly surrounds the opening at the open end 24. In use, when the towel cover 10 is attached to a golf bag 1, trolley or other object, the stiffening ring or loop 30 enables the open end 24 of the tubular protective sheath member 20 to be moved, or slid, towards the closed end 23 to facilitate access to the towel 12.

The attachment member 14 may comprise any convenient means for attaching the towel cover 10 to an object 1. For example, the attachment member 14 may comprise a hook, clip, chain or cord extending through at least one hole 26 provided in the protective sheath member 20.

The tubular protective sheath member 20 may be conveniently formed from a rectangular piece of water repellant fabric material, such as nylon, with two opposite sides of the rectangle joined together to form a tube. One end of the tube is then flattened to form an overlapping double layer of fabric which can then be joined together, e.g. by stitching or an adhesive, to form the closed end 23 of the protective sheath member 20. It will, however, be appreciated that a generally tubular protective sheath member of the form illustrated in the drawings may be formed by other means.

The protective sheath member 20 is provided with retention means for the attachment member 14 in the form of eyelet holes 26 provided in each layer of fabric adjacent the flattened, closed end 23 of the protective sheath member. Each hole 26 is surrounded by a reinforcement ring. Preferably, the eyelets 26 are coaxially alienable to permit extension of the attachment member 14 through them.

Ideally, the attachment member 14 comprises a clip having a generally C-shaped part with a lower curved portion extending through the eyelet holes 26 in the protective sheath member 20, and a straight part extending upwardly from the lower portion. The straight part terminates inwardly of a downwardly depending part of a curved upper portion of the C-shaped part. The clip is preferably formed from a resilient metal or plastics material so that its straight part can be pressed inwardly to enable a ring, bar or other part of a golf bag or trolley or other object to be inserted between the straight part 33 and the downwardly depending part of 34 of the clip. Thereafter, the straight part 33 is biased back towards the curved upper portion 34 by the inherent resilience of the clip to retain the clip to the golf bag, trolley or other object to which the towel cover is to be attached. It will, however, be appreciated that other types of attachment member such as a dog-clip, a hook, chain, cord or the like may be provided instead of the clip shown in the drawings.

The stiffening member 30 extends around the opening in the open end 24 of the protective sheath member 20. Preferably, the stiffening member 30 is a cylindrical stiffening ring which may be held in position around the open end of the protective sheath member 20 by the fabric material being folded over the stiffening member 30 to form and annular pocket 25. Ideally, the open end 24 is coupled to the outer surface 21 to enclose the stiffening member 30. It will, however, be appreciated that the stiffening member 30 may take other shapes or forms, e.g. an open or closed loop of wire, and may be secured to the protective sheath member 20 in position around the opening by other methods.

In use, a towel 12 having a hook or eyelet provided in a corner thereof is attached to the attachment member 14 which extends through the holes in the layers of fabric at the closed ends 23 of the protective sheath member 20. The protective sheath member 20 may then be turned inside out by grasping the stiffening member 30 at the open end 24 of the protective sheath member 20 and pulling the protective sheath member over the towel 12. Preferably, both sides of the protective sheath member 20 are water repellant and can then be attached to a golf bag 1, trolley or buggy by the attachment member 14 so that the towel cover 10 hangs down from the golf bag, trolley or buggy with its closed end 23 forming an upper end, and its open end 24 forming a lower end.

The construction of the towel cover 10 with the protective sheath member 20 being made from a fabric material and the stiffening member 30 being disposed around the open end 24 so that the opening is surrounded by the central opening 32 of the stiffening member 30 enables this procedure to be accomplished with one hand only.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A towel with protective cover assembly, comprising:

a towel having a hole therethrough;

an elongated protective sheath member having an inner surface defining a hollow interior, an outer surface, a closed end, and an open end forming an opening into said hollow interior, said open end having an annular pocket around said open end opening;

said towel being disposed within said hollow interior of said protective sheath member;

wherein said protective sheath member includes a pair of coaxially alignable eyelets proximate said closed end, said eyelets being extended through said protective sheath member into said hollow interior of said protective sheath member;

an attachment member being coupled to said towel and said protective sheath member proximate said closed end of said protective sheath member, said attachment member being for attachment to an object;

wherein said attachment member is extended through said pair of eyelets and said hole in said towel whereby said towel is coupled to said protective sheath member; and a stiffening member having a central opening, said stiffening member being disposed within said annular pocket, said stiffening member being for helping slide said open end of said protective sheath member over said towel;

wherein said protective sheath member is tapered towards said closed end;

wherein said open end is folded back over said outer surface of said protective sheath member to form said annular pocket;

wherein said open end is coupled to said outer surface of said protective sheath member;

wherein said protective sheath member comprises a substantially water repellant material;

wherein said attachment member is detachably coupled to said towel and said protective sheath member through said hole in said towel and said eyelets in said protective sheath member;

wherein said stiffening member is disposed within said annular pocket such that said central opening of said stiffening member surrounds said opening of said protective sheath member open end.

* * * * *